US007823639B2

(12) United States Patent
Braden

(10) Patent No.: US 7,823,639 B2
(45) Date of Patent: Nov. 2, 2010

(54) STRUCTURE FOR WIRED DRILL PIPE HAVING IMPROVED RESISTANCE TO FAILURE OF COMMUNICATION DEVICE SLOT

(75) Inventor: Jason Braden, Pearland, TX (US)

(73) Assignee: IntelliServ, LLC, Houston, TX (US)

( * ) Notice: Subject to any disclaimer, the term of this patent is extended or adjusted under 35 U.S.C. 154(b) by 526 days.

(21) Appl. No.: 11/862,904

(22) Filed: Sep. 27, 2007

(65) Prior Publication Data

US 2009/0084541 A1 Apr. 2, 2009

(51) Int. Cl.
*E21B 17/00* (2006.01)

(52) U.S. Cl. ..... 166/242.6; 439/191

(58) Field of Classification Search ..... 166/242.6, 166/65.1; 439/191, 310
See application file for complete search history.

(56) References Cited

U.S. PATENT DOCUMENTS 3,518,609 A * 6/1970 Fontenot, Jr. ..... 439/191
5,964,486 A * 10/1999 Sinclair ..... 285/331
6,670,880 B1 12/2003 Hall et al.
6,992,554 B2 1/2006 Hall et al.
7,040,018 B2 * 5/2006 Lohbeck et al. ..... 29/890.144
7,091,810 B2 8/2006 Hall et al.
7,093,654 B2 8/2006 Hall et al.
7,116,199 B2 10/2006 Hall et al.
2002/0193004 A1 12/2002 Boyle et al.
2003/0156918 A1 8/2003 Benedict et al.
2005/0074998 A1 4/2005 Hall et al.
2006/0225926 A1 10/2006 Madhavan et al.
2007/0010119 A1 1/2007 Hall et al.
2008/0217916 A1 * 9/2008 Nagasaku et al. ..... 285/334

FOREIGN PATENT DOCUMENTS

RU 204 0691 7/1995

OTHER PUBLICATIONS

International Search Report and Written Opinion Dated Apr. 2, 2009 for Appl. No. PCT/US2008/075720; (12 p.).

* cited by examiner

*Primary Examiner*—Daniel P Stephenson
(74) *Attorney, Agent, or Firm*—Conley Rose, P.C.

(57) ABSTRACT

A structure for wired drill pipe includes a pipe joint having a pin end and a box end. The pin end and box end each have threads for engagement with corresponding threads on a respective box and pin of an adjacent pipe joint. A longitudinal end of the threads on the pin and on the box include at least in an internal shoulder for engagement with a corresponding internal shoulder on an adjacent box or pin. The internal shoulder of each of the pin and the box includes a groove around a circumference thereof for retaining a communication device therein. An external flank of the groove on the pin, and a corresponding surface of the box include deflection resistance feature.

21 Claims, 6 Drawing Sheets

STRUCTURE FOR WIRED DRILL PIPE HAVING IMPROVED RESISTANCE TO FAILURE OF COMMUNICATION DEVICE SLOT

BACKGROUND OF THE INVENTION

1. Field of the Invention

The invention relates generally to the field of wellbore drilling systems and equipment. More specifically, the invention relates to structures for "wired" drill pipe that include a power and/or signal channel associated therewith and that have improved reliability.

2. Background Art

Rotary drilling systems known in the art for drilling wellbores through subsurface Earth formations typically use threadedly coupled segments ("joints") of pipe suspended at the Earth's surface by a drilling unit called a "rig." The pipe is used, in association with certain types of tools such as collars and stabilizers to operate a drill bit disposed at the longitudinal end of a "string" of such pipe joints coupled end to end. As a wellbore is drilled, and it becomes necessary to lengthen the string of pipe, additional joints of pipe are coupled to the string by threading them onto the upper (surface) end of the string of pipe. Removing the string of pipe from the wellbore, such as to replace a drill bit, requires uncoupling joints or "stands" (segments consisting of two, three or four coupled joints) of the pipe string and lifting the string from the wellbore. Such coupling and uncoupling operations are an ordinary and necessary part of drilling a wellbore using a rig and such pipe strings ("drill strings").

It is known in the art to include various types of measuring devices near the lower end of a drill string in order to measure certain physical parameters of the wellbore and the surrounding Earth formations during the drilling of the wellbore. Such instruments are configured to record signals corresponding to the measured parameters in data storage devices associated with the measuring devices. The measuring and storing devices require electrical power for their operation. Typically such power is provided by batteries and/or a turbine powered electrical generator associated with the measuring devices. The turbine may be rotated by the flow of drilling fluid ("mud") that is pumped through a central passageway or conduit generally in the center of the pipes and tools making up the drill string. It is also known in the art to communicate certain signals representative of the measurements made by the devices in the wellbore to the Earth's surface at or close to the time of measurement by one or more forms of telemetry. One such form is extremely low frequency ("ELF") electromagnetic telemetry. Another is modulation of the flow of mud through the drill sting to cause detectable pressure and/or flow rate variations at the Earth's surface, called "mud-pulse telemetry."

The foregoing power and telemetry means have well known limitations. It has been a longstanding need in the art of wellbore drilling to provide electrical power and a relatively high bandwidth communication channel along a drill sting from the bit to the Earth's surface. Various structures have been devised to provide insulated electrical conductors in association with drill pipe to provide such power and signal channels for a drill string. The features of the structures that have been developed for such insulated electrical conductor channels are related to the particular requirements for pipes used for drill strings, namely, that they must be made so as to cause as little change as possible in the ordinary handling and operation of drill pipe. As will be appreciated by those skilled in the art, such handling includes repeated threaded coupling and uncoupling. Use of the pipe string during drilling will result in application to the pipe string of torsional stress, bending stress, compressional and tensional stress, as well as extreme shock and vibration.

One type of "wired" drill pipe is described in U.S. Patent Application Publication No. 2006/0225926 filed by Madhavan et al. and assigned to the assignee of the present invention. The wired drill pipe disclosed in the '926 publication includes a conduit for retaining wires in the wall of or affixed to the wall of a joint of drill pipe, as well as electromagnetic couplings for the wires proximate the longitudinal ends of the pipe joint. The electromagnetic coupling is typically disposed in a groove, slot or channel formed in a portion of the treaded coupling called a "shoulder" or thread shoulder. A thread shoulder is a surface that extends substantially laterally (transverse to the longitudinal axis of the pipe) and is included to perform functions such as transferring axial stress across the threaded coupling to the adjacent pipe joint, and to form a metal to metal seal so that fluid pressure inside the pipe will be retained therein. It has been observed that the groove or slot in wired drill pipe may be failure prone.

There continues to be a need for improvements to structures for wired drill pipe to increase their reliability and ease of handling during drilling operations.

SUMMARY OF THE INVENTION

A structure for wired drill pipe according to one aspect of the invention includes a pipe joint having a pin end and a box end. The pin end and box end each have treads for engagement with corresponding threads on a respective box and pin of an adjacent pipe joint. A longitudinal end of the threads on the pin and on the box include at least in an internal shoulder for engagement with a corresponding internal shoulder on an adjacent box or pin. The internal shoulder of each of the pin and the box includes a groove around a circumference thereof for retaining a communication device therein. A flank of the groove on the pin, and a corresponding surface of the box includes a deflection resistance feature.

A method for making a wired pipe according to another aspect of the invention includes forming a circumferential groove in a longitudinal end face of an internal thread shoulder on each of a pin end and a box end of a pipe joint having a threaded connection at each longitudinal end thereof. Each groove is configured to retain a communication device therein. Deflection resistance features are formed in corresponding surfaces of a flank on the pin end defined by the groove in the pin end and in the box end. As a result, outward lateral deflection of the flank is opposed by the corresponding surface in the box end of an adjacent pipe joint when made up to the pin end.

Other aspects and advantages of the invention will be apparent from the following description and the appended claims.

DETAILED DESCRIPTION

Figure 1:
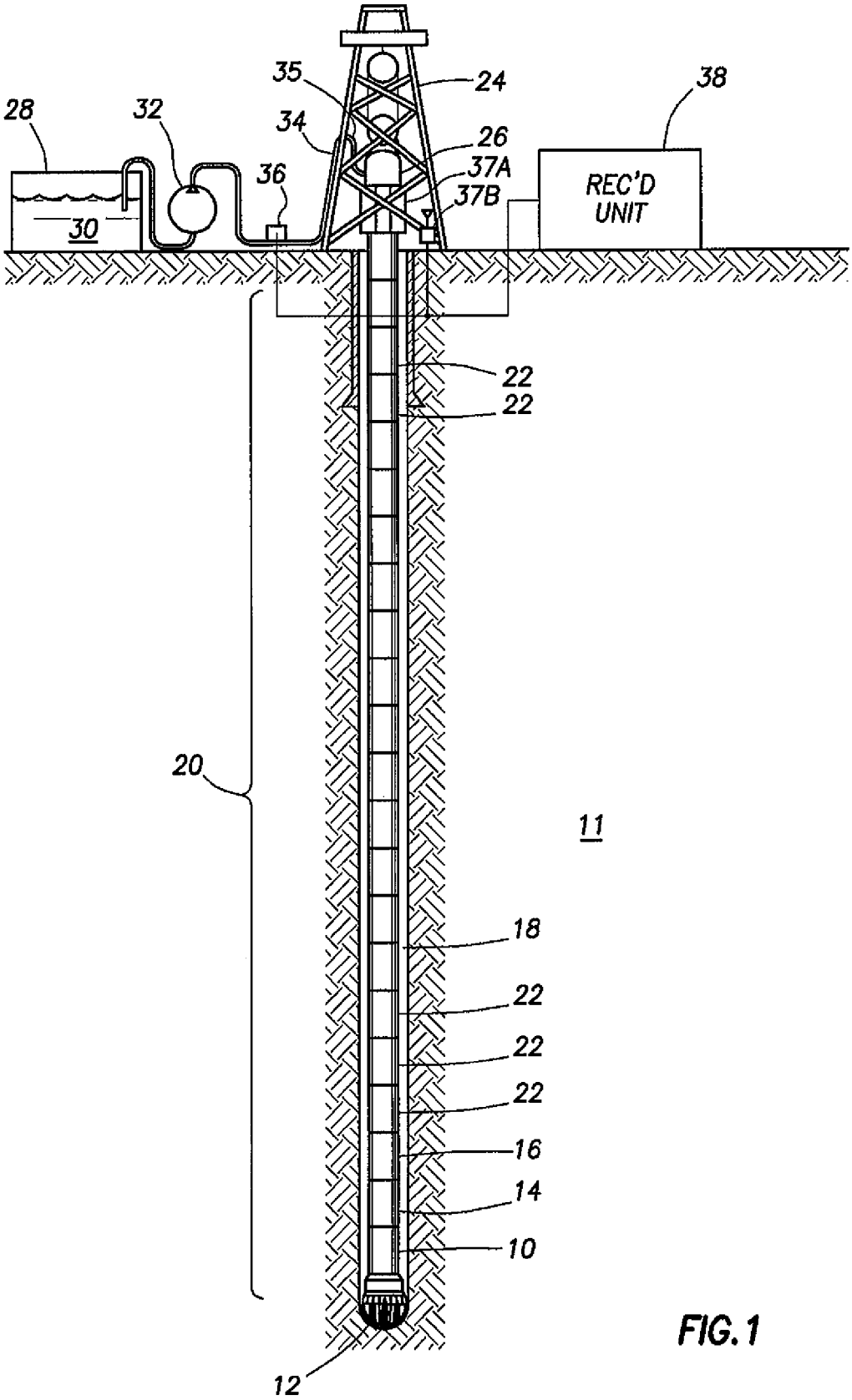
FIG. 1 shows an example drilling system with which the invention may be used.

An example wellbore drilling system with which various implementations of wired drill pipe according to the invention is shown schematically in FIG. 1. A drilling rig 24 or similar lifting device suspends a conduit called a "drill string" 20 within a wellbore 18 being drilled through subsurface Earth formations 11. The drill string 20 may be assembled by threadedly coupling together end to end a number of segments ("joints") 22 of drill pipe. The drill string 20 may include a dill bit 12 at its lower end. When the drill bit 12 is urged into the formations 11 at the bottom of the wellbore 18 and when it is rotated by equipment (e.g., top drive 26) on the drilling rig 24, such urging and rotation causes the bit 12 to axially extend ("deepen") the wellbore 18 by drilling the formations 11. The lower end of the drill string 20 may include, at a selected position above and proximate to the drill bit 12, an hydraulically operated motor ("Mud motor") 10 to rotate the drill bit 12 either by itself or in combination with rotation of the pipe string 20 from the surface. Near the lower end of the drill string 20, it may also include one or more MWD instruments 14 and/or an LWD instruments 16, of types well known in the art.

During drilling of the wellbore 18, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the drill string 20. The mud 30 exits the drill string 20 through courses or nozzles (not shown separately) in the drill bit 12, where it then cools and lubricates the drill bit 12 and lifts drill cuttings generated by the drill bit 12 to the Earth's surface. Some examples of MWD instrument 14 or LWD instrument 16 may include a telemetry transmitter (not shown separately) that modulates the flow of the mud 30 through the drill string 20. Such modulation may cause pressure variations in the mud 30 that may be detected at the Earth's surface by a pressure transducer 36 coupled at a selected position between the outlet of the pump 32 and the top drive 26. Signals from the transducer 36, which may be electrical and/or optical signals, for example, may be conducted to a recording unit 38 for decoding and interpretation using techniques well known in the art. The decoded signals typically correspond to measurements made by one or more of the sensors (not shown) in the MWD instrument 14 and/or the LWD 16 instrument. In the present example, such mud pressure modulation telemetry may be used in conjunction with, or as backup for an electromagnetic telemetry system including wired drill pipe. An electromagnetic transmitter (not shown separately) may be included in the LWD instrument 16, and may generate signals that are communicated along electrical conductors in the wired drill pipe. One type of "wired" drill pipe, as mentioned above in the Background section herein, is described in U.S. Patent Application Publication No. 2006/0225926 filed by Madhavan, et al., and assigned to the assignee of the present invention. A wireless transceiver sub 37A may be disposed in the uppermost part of the drill string 20, typically directly coupled to the top drive 26. The wireless transceiver 37A may include communication devices to wirelessly transmit data between the drill string 20 and the recording unit 38, using a second wireless transceiver 37B associated with the recording unit.

It will be appreciated by those skilled in the art that the top drive 26 may be substituted in other examples by a swivel, kelly, kelly bushing and rotary table (none shown in FIG. 1) for rotating the drill string 20 while providing a pressure sealed passage through the drill string 20 for the mud 30. Accordingly, the invention is not limited in scope to use with top drive drilling systems.

Figure 2:
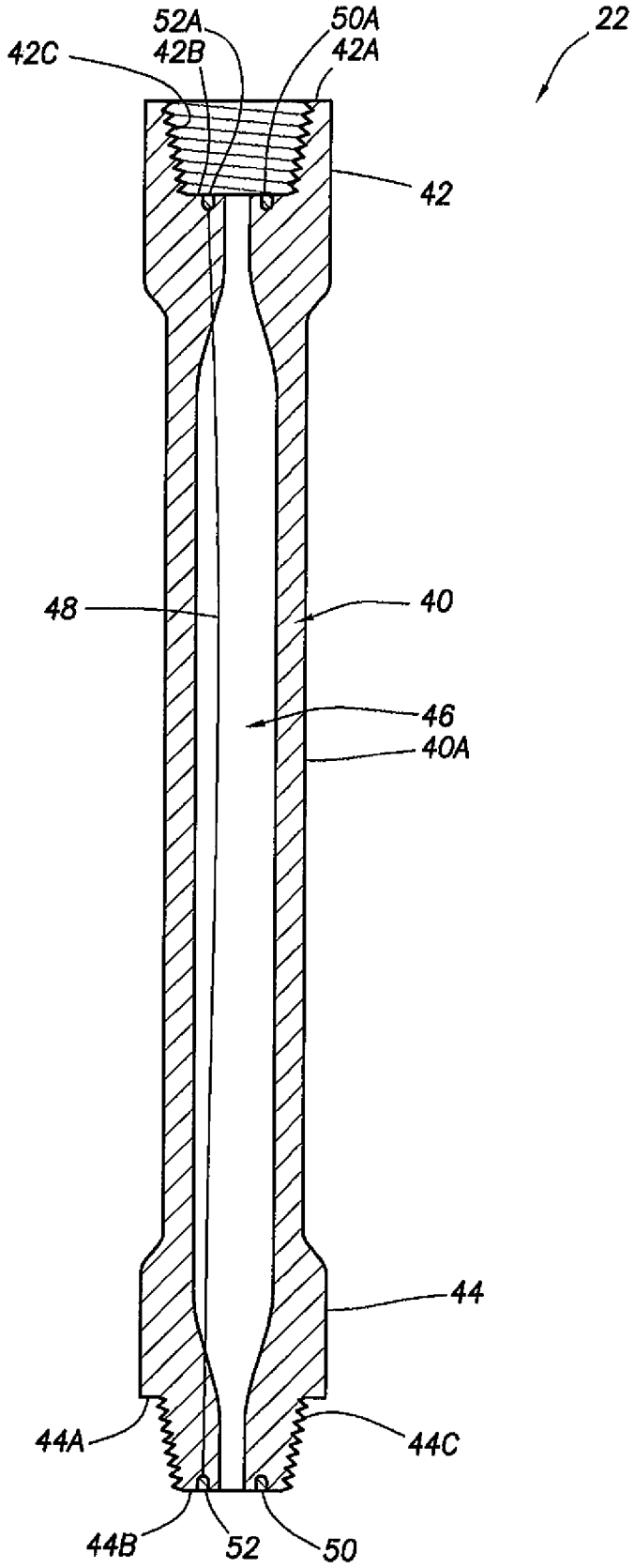
FIG. 2 shows a cross section of one example of wire drill pipe.

Referring to FIG. 2, an example of a joint of wired drill pipe is shown in cross section. The pipe joint 22 includes a generally tubular shaped mandrel 40 having a central portion 40A of selected length, diameter and wall thickness. An interior passage 46 is provided so that the drilling mud (see FIG. 1) can pass freely through the pipe joint 22. A tool joint is disposed at each longitudinal end of the mandrel 40. The tool joints typically have greater wall thickness and outer diameter than the central portion 40A so that various stresses applied to the pipe string (20 in FIG. 1) may be transferred across the threaded connection between pipe joints without failure thereof. A tool joint 44 having a male threaded coupling therein is called a "pin" and is disposed at the lower end of the pipe joint 22 shown in FIG. 2. A tool joint 42 having a female threaded coupling therein called a "box" is shown at the other end of the pipe joint 22. The box of one pipe joint threadedly engages the pin end of the adjacent pipe joint to make the threaded connection.

The type of threaded connection used with typical examples of wired drill pipe, such as the one shown in FIG. 2 is called a "double shoulder" threaded connection. For example, the pin 44 includes an internal shoulder 44B on the "nose" thereof that mates with a corresponding internal shoulder 42B in the box 42 when tapered thread 44C on the pin 44 is engaged with (called "made up") corresponding tapered thread 42C on the box 42. An external shoulder 44A on the pin 44 mates with a corresponding shoulder 42A on the box 42 when the pin 44 and box 42 are made up.

Wired drill pipe, as described in the Madhavan, et al., patent application publication mentioned above, can include a wire conduit 48 that extends from a groove 50 formed in the internal shoulder 44B of the pin 44 to a corresponding groove 50A formed in the internal shoulder 42A of the box 42. Typically, a passage or bore will be formed from an innermost portion of the grooves 50, 50A through the wall of the respective tool joints 44, 42 to the internal passage 46 inside the pipe joint 22. Example structures for such grooves and passages are also described in the Madhavan, et al., patent application publication mentioned above. The conduit 48 provides protection for one or more insulated electrical conductors or optical conductors (not shown). The one or more electrical or optical conductors (not shown) can terminate in a communication coupling 52, 52A such as an electromagnetic coupling or an optical coupling, disposed in each groove 50, 50A. The communication coupling 52, 52A can provide a signal and electrical power communication path between the electrical conductors (not shown) in adjacent pipe joints 22 in the pipe string (20 in FIG. 1). The grooves 50, 50A are typically formed so as to traverse the entire circumference of the respective thread shoulders 44, 42.

Figure 3:
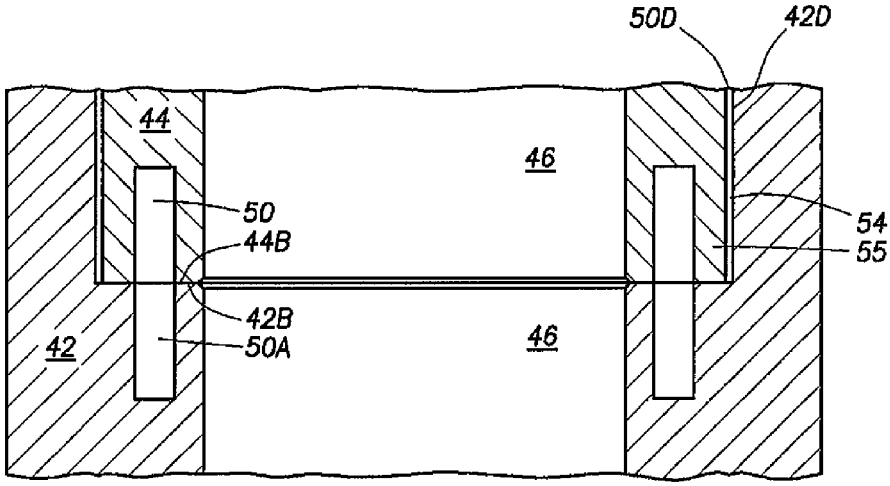
FIG.3 (PRIOR ART)
FIG. 3 shows an example of a prior art threaded connection for wired drill pipe including a groove or slot for a communication coupling.

An example of a prior art connection showing the adjacent grooves in the pin and the box in more detail can be observed in FIG. 3 to help explain the invention. FIG. 3 shows a detailed view of the internal shoulder in each of the box 42 and the pin 44. When the pin 44 and box 42 are completely made up, as previously explained, the internal shoulders 44B, 42B come into contact with each other to form a metal to metal seal, so that fluid under pressure in the internal passage 46 is retained therein. When the pin 44 and the box 42 are made up, a lateral outer surface 50D of the pin nose is disposed proximate a lateral inner surface 42D of the base of the box 42 to form an enclosed space or cavity 54. The cavity 54 is typically at atmospheric pressure, because fluid pressure inside the pipe string (20 in FIG. 1) is prevented from entering the cavity 50D by the metal to metal seal formed between the inner shoulders 44B, 44B of the pin and box, respectively, when the threaded connection is made up. Although not shown in FIG. 3, the outer shoulders (see 44A and 42A in FIG. 2) of the threaded connection also form a metal to metal seal, so that fluid under pressure in the wellbore (18 in FIG. 1) will be prevented from entering the cavity 50D from outside the pipe string (20 in FIG. 1).

A portion of the pin nose disposed laterally outside the groove cab be referred to herein an "external flank" 55. The external flank 55 is an artifact of making the groove 50 around the entire circumference of the pin 44 nose. It is believed that the external flank 55 is subject to lateral outward deflection under certain types of stress. Such deflection of the external flank 55 may result from the unavoidably small wall thickness of the external flank 55, and is believed that such lateral deflection contributes to premature failure of the threaded connection between the pin 44 and nose 42. Such failure may include leakage of fluid under pressure from the interior passage 46 to the exterior of the pipe string (20 in FIG. 1) through the threads, penetrating the metal to metal seal formed by the external shoulders (44A, 42A in FIG. 2) when made up. Such failure is called a "washout" and is characterized by erosion of the threads (see 44C and 42C in FIG. 2) as well as the internal and external thread shoulders.

In various examples of a wired drill pipe joint according to the invention, a means for reducing lateral deflection of the external flank 55 in the pin nose may be provided to reduce incidence of, for example, the above described types of failure. Examples of a means for reducing lateral deflection of the external flank 55 will now be explained with reference to FIGS. 4 through 8.

Figure 4:
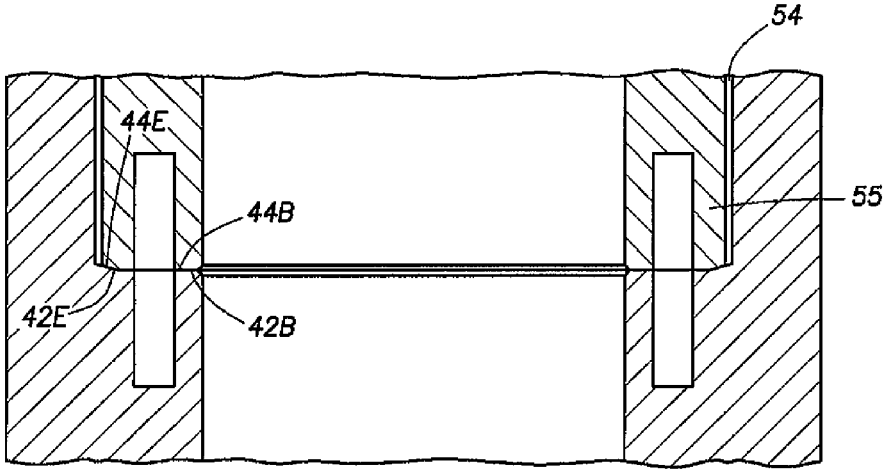
FIGS. 4 through 9 show various examples of an improved slot and thread shoulder according to the invention.

In FIG. 4, a laterally exterior portion 44E of the external flank 55, on the internal shoulder 44B of the pin 44, may be tapered or sloped as shown in FIG. 4. The portion of the internal shoulder 42B forming a mating surface 42E thereto in the box 42 may be correspondingly tapered or sloped, so that when the box 42 is engaged to the pin 44, the external flank 55 is held laterally by the mating sloped surfaces 42E, 44E. The structure shown in FIG. 4 is believed to have increased resistance to lateral outward deflection of the flank 55.

Figure 5:
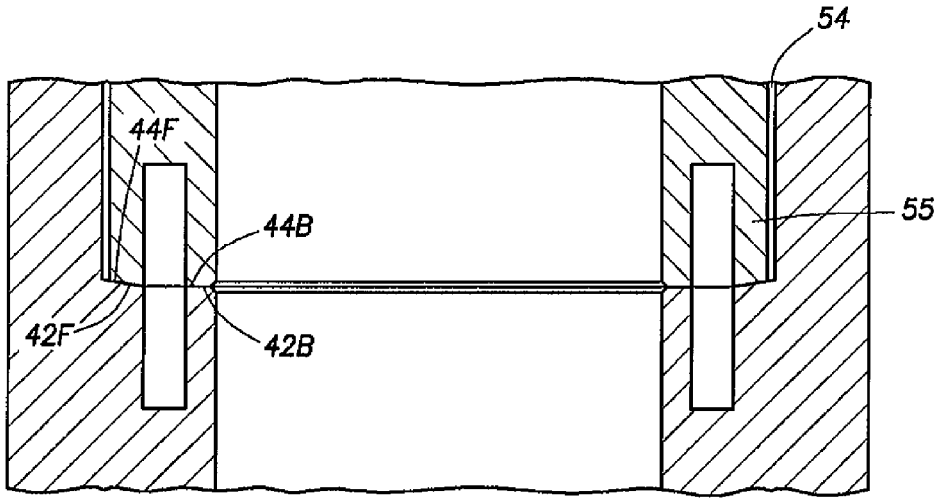

Another example of means for resisting lateral outward deflection of the flank 55 is shown in FIG. 5, where the entire mating surface 44F of the outer flank 55 is tapered, and the corresponding mating surface 42F of the box 42 is correspondingly tapered.

Figure 6:
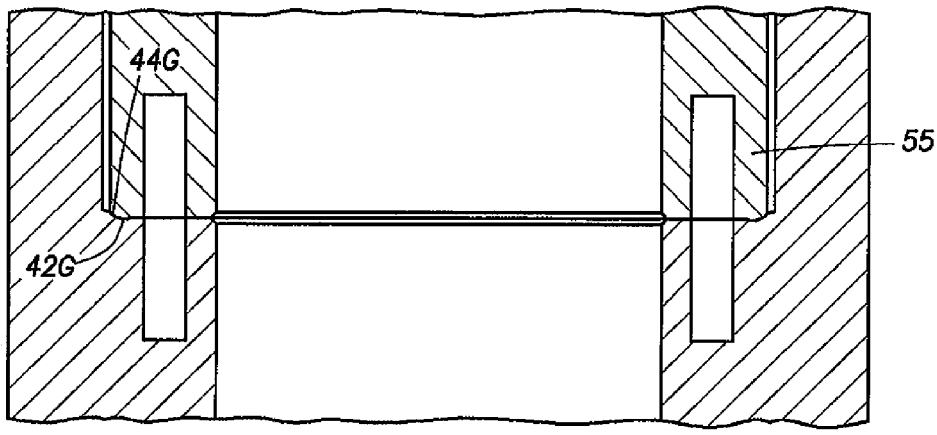
Figure 7:
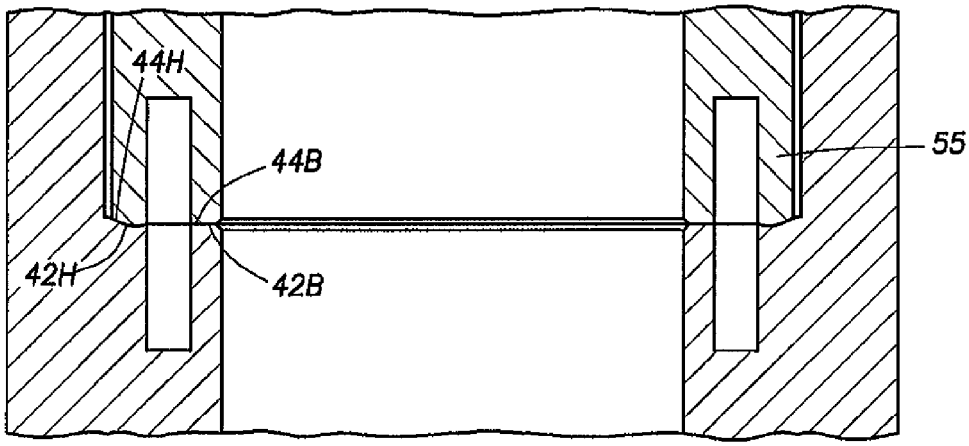

Another example shown in FIG. 6 includes a longitudinally protruding feature such as crest 44G formed on part of the mating surface of the flank 55. A corresponding receiving feature 42G may be formed in the mating surface of the box 42. When engaged, the protruding feature 44G and receiving feature 42G cooperate to cause the flank 55 to resist lateral outward deflection. A similar combination of protruding feature and receiving feature is shown in FIG. 7 at 44H on the flank 5 and 42H in the box, respectively, where such features are formed across essentially the entire mating surface of the box 42 and flank 55 of the pin 44.

Figure 8:
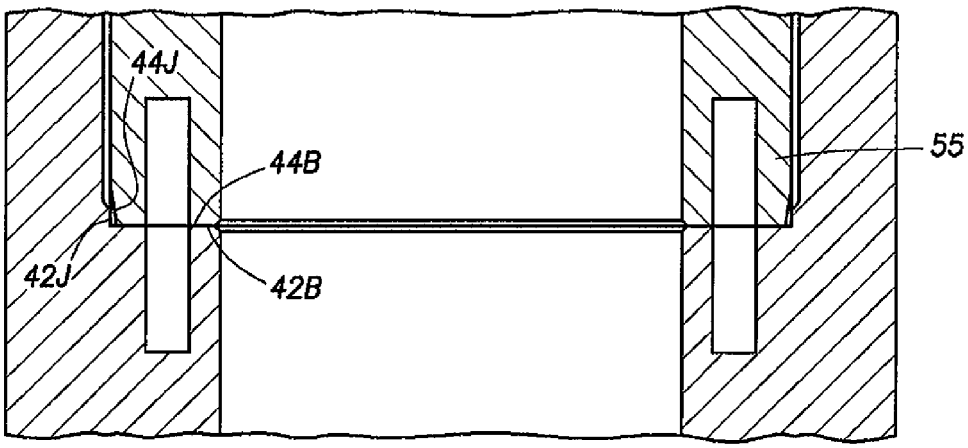

Another example of means for resisting lateral outward deflection of the flank 55 is shown in FIG. 8, wherein an internal, lateral surface 42J of the box includes an inward taper, and a corresponding lateral outward surface 44J of the flank 55 includes a cooperatively shaped taper. When the pin 44 and box 42 are made up, the tapered surfaces 44J and 42J engage each other to resist lateral outward deflection of the flank 55.

Figure 9:
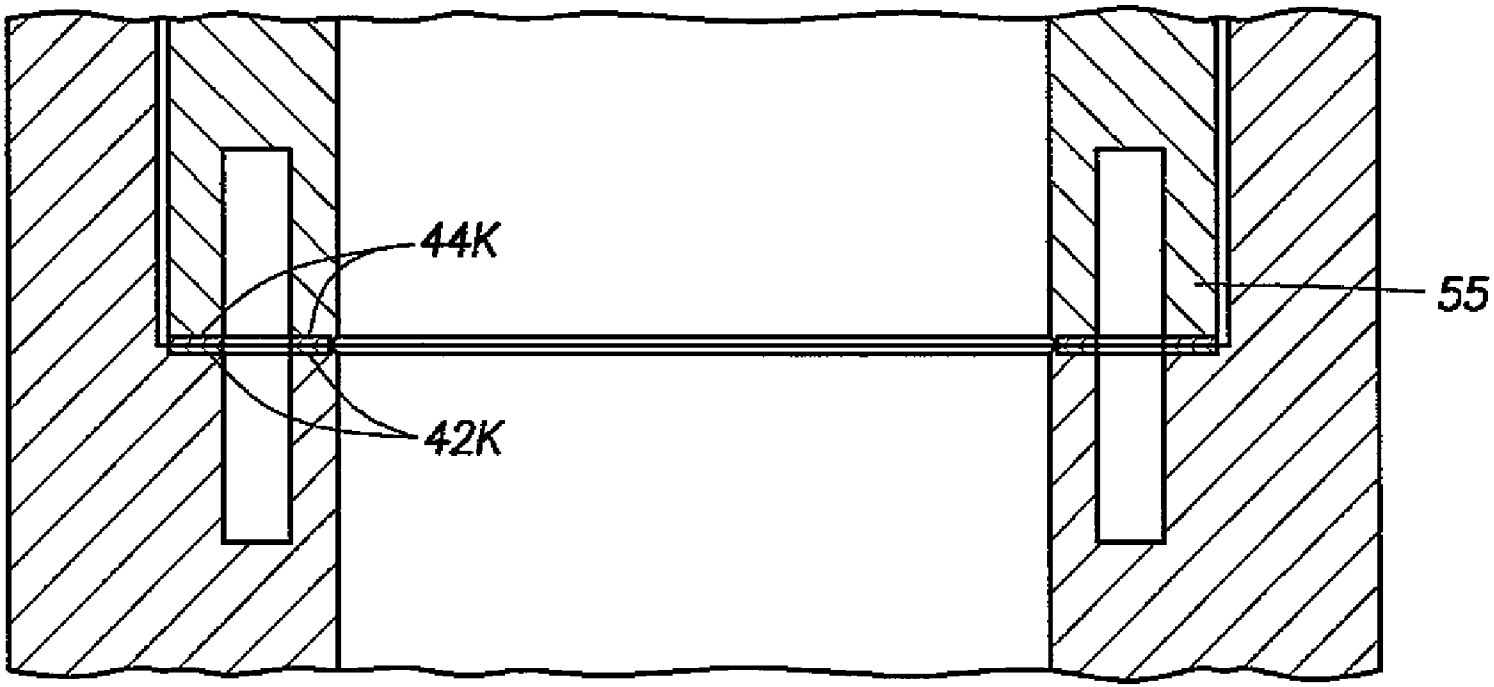

Another example of means to resist lateral outward deflection of the flank 55 is shown in FIG. 9. In FIG. 9, mating surfaces of the flank 55 and the box 42 include a plated or otherwise deposited high friction surface 44K, 42K, for example, tungsten carbide or cubic boron nitride. The high friction surface 44K, 42K is preferably made from material that has a higher coefficient of friction than the material from which the pipe joint 22 is made. Typically, the material used to make the pipe joint will be steel or other high strength metal. When the pin and box are engaged, the high friction surfaces 42K, 44K cooperate to resist lateral outward deflection of the flank 55.

Wired drill pipe made according to the invention may have increased resistance to failure of the threaded connections between adjacent pipe joints. It is noted that the above examples show a deflection resistance feature on the external flank. In any instance where it is desirable to prevent deflection on the interior flank, any of the above-described features may be included on the internal flank. In addition, the deflection resistance features may be used with drill pipe, as describes, as well as with heavy weight drill pipe, drill collars, heavy weight drill collars, drilling jars, and tool joint connections.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wired drill pipe, comprising:

a pipe joint having a pin at one longitudinal end and a box at another longitudinal end, the pin and the box each having threads for engagement with corresponding threads on a respective box or pin of an adjacent pipe joint, a longitudinal end of the threads on the pin and the box each including at least in an internal shoulder for engagement with a corresponding internal shoulder on an adjacent box or pin, an end face of the internal shoulder of each of the pin and box including a groove around a circumference thereof for retaining a communication coupling therein, and wherein a flank of the groove on the pin defined by the groove thereon and a corresponding surface of the box includes a deflection resistance feature;

wherein the deflection resistance feature comprises a layer of material deposited on at least a surface of the shoulder of the flank having higher coefficient of friction than a material from which the pipe is made.

2. The pipe of claim 1 wherein the deflection resistance feature comprises a taper on at least part of a surface of the shoulder of the flank and a mating taper on a surface of the shoulder in the box.

3. The pipe of claim 1 wherein the deflection resistance feature comprises a protruding feature on at least part of a surface of the shoulder of the flak and a mating recessed feature on a surface of the shoulder in the box.

4. The pipe of claim 1 wherein the deflection resistance feature comprises a taper on a lateral exterior surface of the flank and a corresponding taper on an interior surface of the box.

5. The pipe of claim 1 wherein the material comprises one of tungsten carbide and cubic boron nitride.

6. The pipe of claim 1 further comprising a wire conduit extending from the groove in the pin shoulder to the groove in the box shoulder.

7. The pipe of claim 1 further comprising a communication coupling disposed in each of the groove in the pin shoulder and the groove in the box shoulder.

8. The pipe of claim 1, where in the flank comprises an external flank.

9. A wired drill pipe sting, comprising:

a plurality of pipe joints threadedly coupled end to end, each pipe joint having a pin at one longitudinal end and a box at another longitudinal end, the pin and the box each having threads for engagement with corresponding threads on a respective box or pin of an adjacent pipe joint, a longitudinal end of the threads on the pin and the box each including at least in an internal shoulder for engagement with a corresponding internal shoulder on an adjacent box or pin, an end face of the internal shoulder of each of the pin and box including a groove around a circumference thereof for retaining a communication coupling therein, and wherein a flank of the groove on the pin defined by the groove thereon and a corresponding surface of the box includes a deflection resistance feature;

wherein the deflection resistance feature comprises a layer of material deposited on at least a surface of the shoulder of the flank having higher coefficient of friction than a material from which the pipe is made.

10. The pipe string of claim 9 wherein the deflection resistance feature comprises a taper on at least part of a surface of the shoulder of the flank and a mating taper on a surface of the shoulder in the box.

11. The pipe string of claim 9 wherein the deflection resistance feature comprises a protruding feature on at least part of a surface of the shoulder of the flank and a mating recessed feature on a surface of the shoulder in the box.

12. The pipe string of claim 9 wherein the deflection resistance feature comprises a taper on a lateral exterior surface of the flank and a corresponding taper on an interior surface of the box.

13. The pipe string of claim 9 wherein the material comprises one of tungsten carbide and cubic boron nitride.

14. The pipe string of claim 9 further comprising a wire conduit extending from the groove in the pin shoulder to the groove in the box shoulder.

15. The pipe sting of claim 9 further comprising a communication coupling disposed in each of the groove in the pin shoulder and the groove in the box shoulder.

16. The pipe string of claim 9, wherein the flank is an external flank.

17. A method for making a wired pipe, comprising:

forming a circumferential groove in a longitudinal end face of an internal thread shoulder on each of a pin end and a box end of a pipe joint having a threaded connection at each longitudinal end thereof, the groove configured to retain a communication device therein; and forming deflection resistance features in corresponding surfaces of an external flank on the pin end defined by the groove in the pin end and in the box end, whereby outward lateral deflection of the external flank is opposed by the corresponding surface in the box end of an adjacent pipe joint when made up to the pin end;

wherein forming deflection resistance features comprises forming a layer of material deposited on at least a surface of the shoulder of the flank having higher coefficient of friction than a material from which the pipe is made.

18. The method of claim 17 wherein the forming deflection resistance features for resisting comprises a forming taper on at least part of a surface of the shoulder of the flank and forming a mating taper on a surface of the shoulder in the box.

19. The method of claim 17 wherein the forming deflection resistance features for resisting comprises forming a protruding feature on at least part of a surface of the shoulder of the flank and a forming mating recessed feature on a surface of the shoulder in the box.

20. The method of claim 17 wherein the forming deflection resistance feature for resisting comprises forming a taper on a lateral exterior surface of the flank and forming a corresponding taper on an interior surface of the box.

21. The method of claim 17 wherein the material comprises one of tungsten carbide and cubic boron nitride.

* * * * *